US006948530B2

(12) United States Patent
Liue

(10) Patent No.: US 6,948,530 B2
(45) Date of Patent: Sep. 27, 2005

(54) WEAVING MACHINE

(75) Inventor: Yung-Ho Liue, Taipei (TW)

(73) Assignee: Yi-Shan Yao, Taichung (TW)

( * ) Notice: Subject to any disclaimer, the term of this patent is extended or adjusted under 35 U.S.C. 154(b) by 72 days.

(21) Appl. No.: 10/749,508

(22) Filed: Jan. 2, 2004

(65) Prior Publication Data

US 2005/0145288 A1 Jul. 7, 2005

(51) Int. Cl.[7] ..... D03D 49/44

(52) U.S. Cl. ..... 139/134; 139/436; 139/439; 139/116.2; 139/449

(58) Field of Search ..... 139/134, 436, 139/439, 116.1, 449

(56) References Cited

U.S. PATENT DOCUMENTS

| | | | | |
|---|---|---|---|---|
| 3,618,640 A | * | 11/1971 | Linka | 139/134 |
| 3,863,682 A | * | 2/1975 | Filter et al. | 139/134 |
| 4,050,481 A | * | 9/1977 | Muller | 139/436 |
| 4,762,153 A | * | 8/1988 | Chuang et al. | 139/134 |
| 4,790,358 A | * | 12/1988 | Linka | 139/436 |
| 4,848,410 A | * | 7/1989 | Linka et al. | 139/134 |
| 4,850,399 A | * | 7/1989 | Linka et al. | 139/436 |
| 4,901,768 A | * | 2/1990 | Chi-Shuang | 139/134 |
| 5,697,404 A | * | 12/1997 | Cheng et al. | 139/134 |
| 6,079,455 A | * | 6/2000 | Speich et al. | 139/455 |
| 6,105,628 A | * | 8/2000 | Duhamel | 139/455 |
| 6,269,842 B1 | * | 8/2001 | Chuang | 139/134 |
| 6,269,844 B1 | * | 8/2001 | Zenoni et al. | 139/452 |
| 6,460,577 B1 | * | 10/2002 | Krumm | 139/57 |
| 6,494,237 B1 | * | 12/2002 | Piegeler | 139/455 |

FOREIGN PATENT DOCUMENTS

| | | | | |
|---|---|---|---|---|
| BR | 9100538 A | * | 9/1992 | D03D 47/27 |
| FR | 1588257 A | * | 4/1970 | D03D 00/00 |
| JP | 01174638 A | * | 7/1989 | D03D 37/00 |

* cited by examiner

*Primary Examiner*—John J. Calvert
*Assistant Examiner*—Robert H Muromoto Jr.
(74) *Attorney, Agent, or Firm*—Rosenberg, Klein & Lee

(57) ABSTRACT

A weaving machine is constructed to use a magnetic traction device to reciprocate the shuttle in moving weft threads over warp threads at a high speed without producing noise and preventing direct contact between parts.

9 Claims, 8 Drawing Sheets

WEAVING MACHINE

BACKGROUND OF THE INVENTION

1. Field of the Invention

The invention relates to weaving machine and, more particularly, to such a weaving machine, which uses magnetic force to reciprocate the shuttle, preventing friction during reciprocating motion of the shuttle.

2. Description of the Related Art

A conventional weaving machine 6, as shown in FIG. 14, comprises a plurality of heddles 61 and hardness member 62. The heddles 61 control the arrangement of two sets of warp threads 7. The shuttle 8 is reciprocated to weave weft threads 71 with warp threads 7. The hardness member 62 is controlled to push weft threads 71 on warp threads 7 toward one side, forming a cloth 9. In an old style weaving machine 6; the shuttle 8 is manually controlled to move back and forth. Modern weaving machines commonly use an automatic mechanical mechanism to control picking motion of the shutter. However, this kind of automatic mechanical mechanism produces a big noise and consumes much electric energy during operation. Further, this kind of automatic mechanical mechanism wears quickly with use. There is another design using high-pressure water to move weft threads. However, this design still consumes much electric energy to compress accumulated water. Further, this design is suitable for threads that are not absorptive to water.

SUMMARY OF THE INVENTION

The present invention has been accomplished under the circumstances in view. It is one object of the present invention to provide a weaving machine, which uses a magnetic traction device to reciprocate the shuttle by means of magnetic floating, preventing the production of noise during reciprocating motion of the shuttle. It is another object of the present invention to provide a weaving machine, which saves power consumption. It is still another object of the present invention to provide a weaving machine, which is durable in use.

To achieve these and other objects of the present invention, the weaving machine comprises a magnetic traction device, the magnetic traction device comprising two magnetic tracks arranged in parallel at two sides of warp threads, a set of magnetic traction plates disposed at two sides of warp threads and defining a contained angle, a plurality of main coils respectively disposed at a bottom side of each of the magnetic traction plates and respectively sleeved onto the magnetic tracks and adapted to reciprocate along the magnetic tracks without contact when alternatively reversely connected with electric current, the magnetic traction plates each having two end magnets and an intermediate magnet respectively disposed at each of two opposing inner sides, said end magnets having magnetic lines of force extending from an outer side toward an inner side, the intermediate magnetic having magnetic lines of force extending from an outer side toward an inner side and from an upper side toward a bottom side, the magnetic tracks each having a buffer spring member at each of two distal ends thereof; a shuttle set in warp threads within the contained angle of the magnetic traction plates and adapted to move weft threads over warp threads, the shuttles comprising two sloping sidewalls, two end magnets respectively disposed at front and rear sides of each of the two sloping sidewalls and adapted to act with the end magnets at the magnetic traction plates to keep the shuttles be suspended within the contained angle of the magnetic traction plates, an intermediate magnet disposed between the two end magnets at each of the two sloping sidewalls and adapted to produce a magnetic repulsive force against the intermediate magnets at the magnetic traction plates to keep the shuttle away from an inner surface of the magnetic traction plates; a set of magnetic rails symmetrically provided at the main coils at a bottom side corresponding to the length of the magnetic tracks; and a set of adjustment plates respectively pivoted to the main coils at a bottom side and adapted to adjust the contained angle of said magnetic traction plates, the adjustment plates each comprising a plurality of lugs respectively pivoted to respective lugs at the main coils, and adjustment screws respectively fastened to the lugs and adapted to adjust the pitch between the adjustment plates and the magnetic rails, the adjustment plates each having a plurality of magnets mounted thereon and adapted to produce a magnetic repulsive force against the magnetic rail to keep the adjustment plates out of contact with the magnetic rails; wherein when electric current is connected to the main coils, a magnetic push force is produced between the main coils and the magnetic tracks to push the main coils and the magnetic traction plates along the magnetic tracks without contacting the magnetic tracks and simultaneously to carry the shuttle, causing the shuttle to move weft threads over warp threads.

BRIEF DESCRIPTION OF THE DRAWINGS

FIG. 9-1 is a schematic sectional view showing the magnetic retainer engaged with the corresponding retaining portion at one supplementary coil according to the present invention.

DETAILED DESCRIPTION OF THE PREFERRED EMBODIMENT

Figure 1:
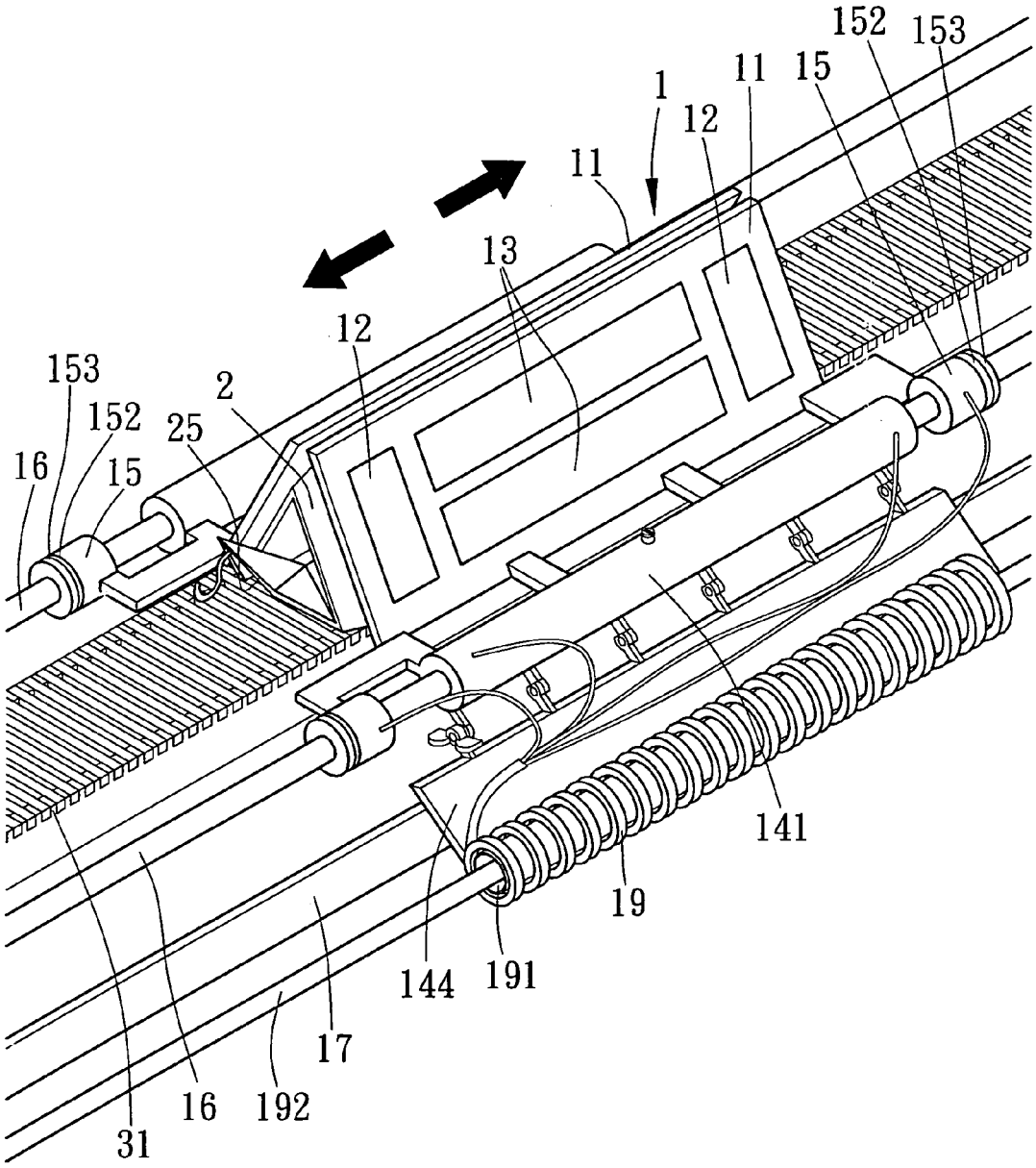
FIG. 1 is a perspective view of a part of the weaving machine according to the present invention, showing the arrangement of the magnetic traction device and the shuttle.
Figure 2:
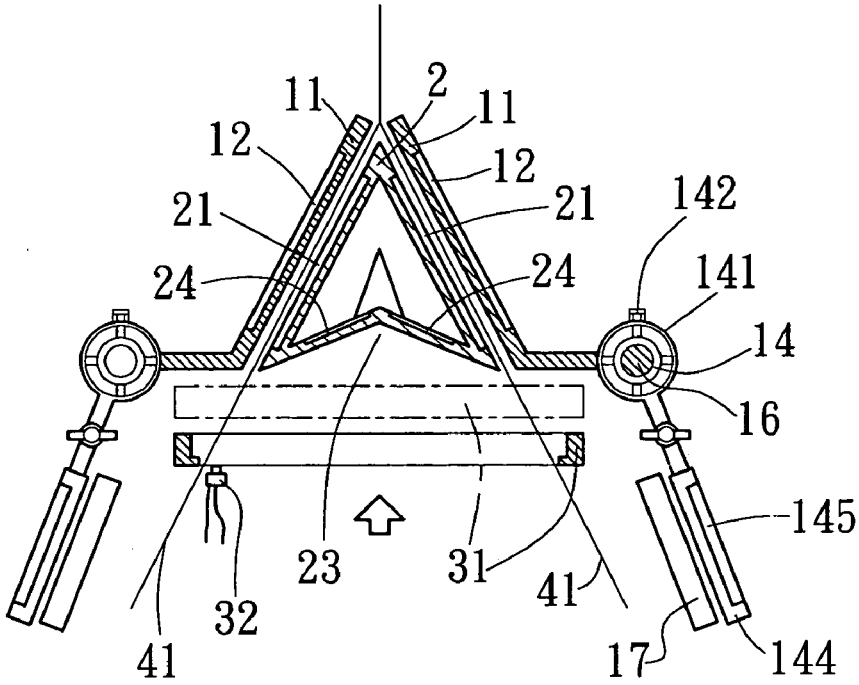
FIG. 2 is a sectional end view of the magnetic traction device and the shuttle according to the present invention.
Figure 3:
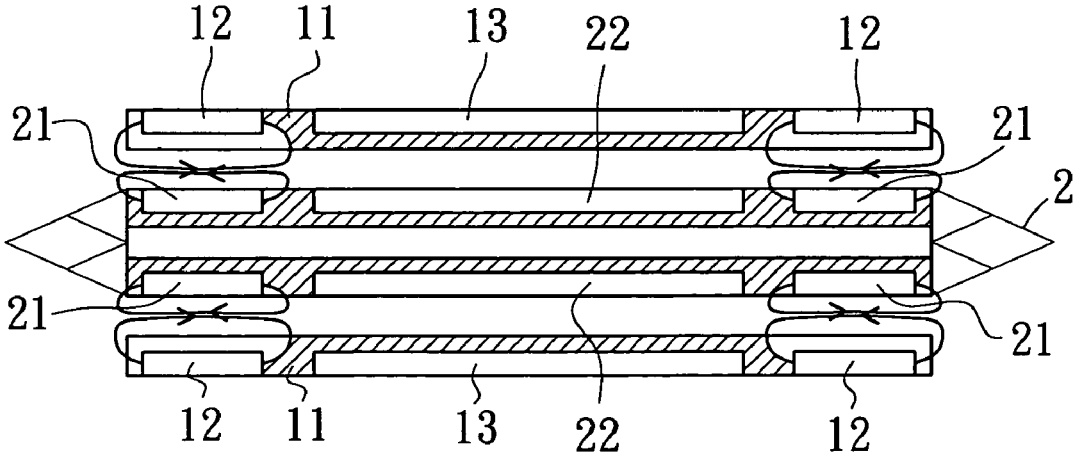
FIG. 3 is a top view in section showing the extending direction of the magnetic lines of force of the end magnets at the magnetic traction plates and the shuttles.
Figure 4:
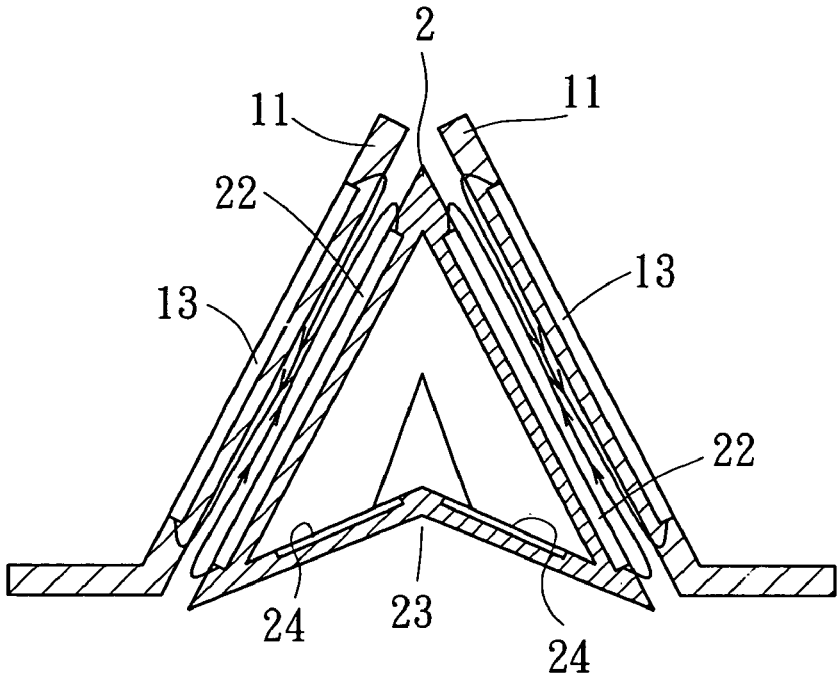
FIG. 4 is a sectional end view showing the extending direction of the magnetic lines of force of the intermediate magnets at the magnetic traction plates and the shuttles.
Figure 5:
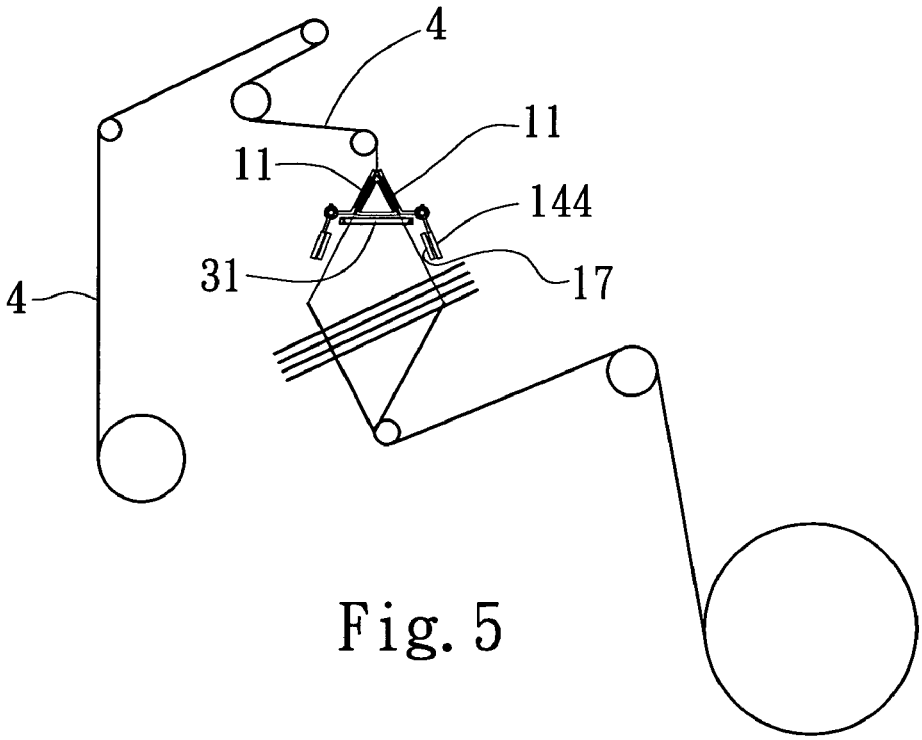
FIG. 5 is a schematic drawing showing the positioning of the magnetic traction device in the weaving machine according to the present invention.
Figure 6:
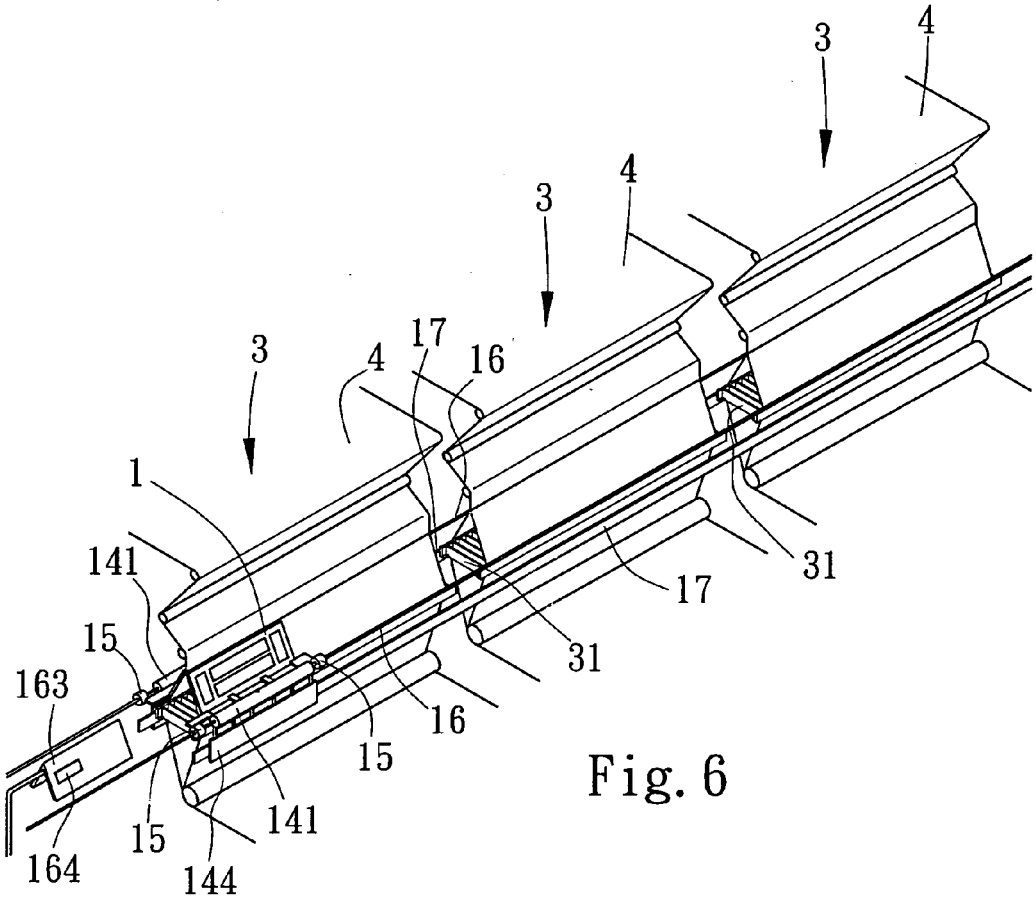
FIG. 6 is a schematic drawing showing a number of weaving machines arranged in parallel according to the present invention.
Figure 8:
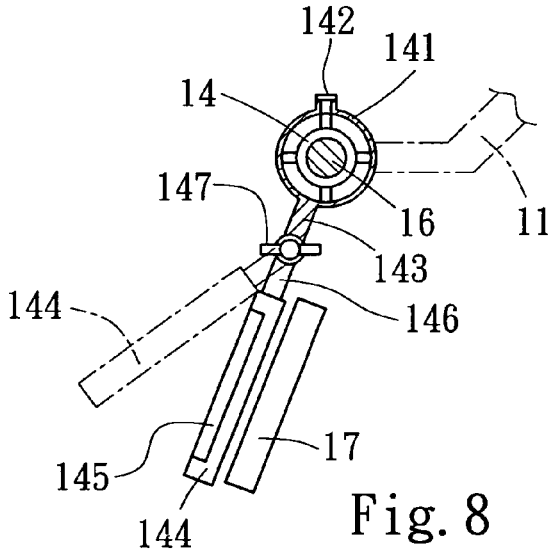
FIG. 8 is a schematic drawing showing adjustment between the adjustment plate and the corresponding magnetic plate according to the present invention.
Figure 7:
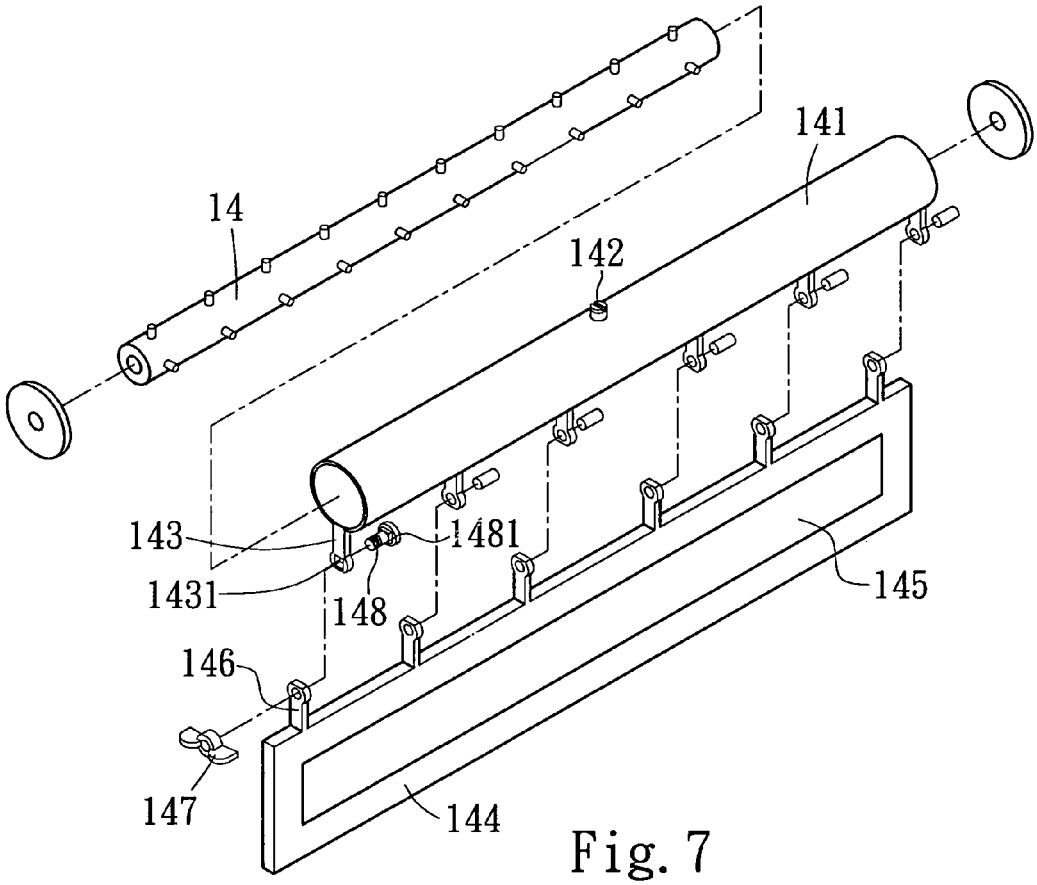
FIG. 7 is an exploded view of a main coil according to the present invention.
Figure 9:
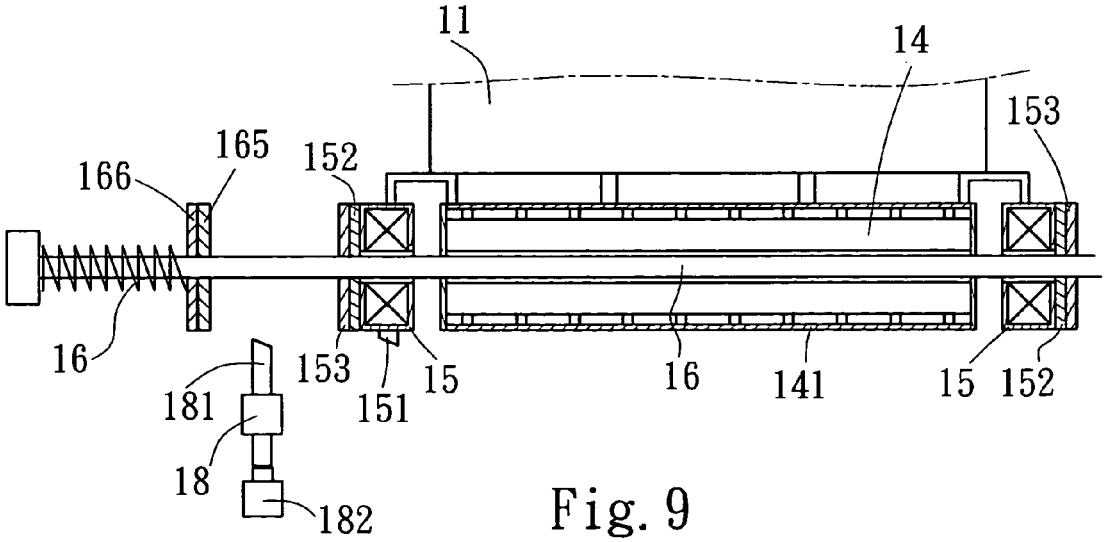
FIG. 9 is a schematic drawing showing the magnetic traction plates moved with the main coils to the spring member at one end of the magnetic tracks and a magnetic repulsive force produced between the magnetic rings at the spring members and the magnetic rings at the main coils.
Figures 1, 9:
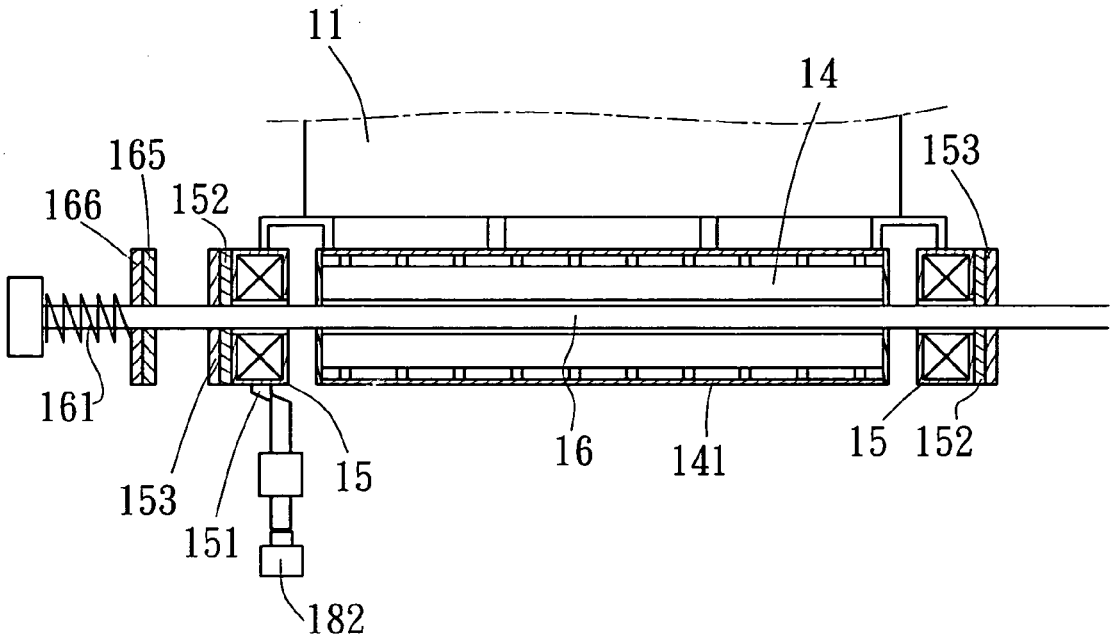
Figure 10:
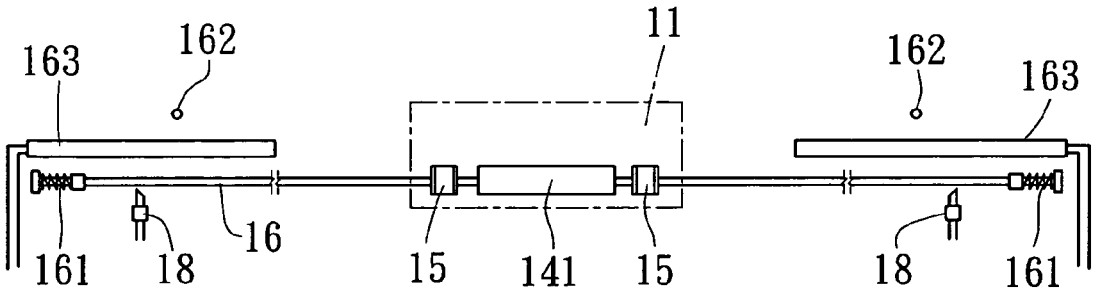
FIG. 10 illustrates the relationship between the magnetic traction device and the magnetic tracks according to the present invention.
Figure 11:
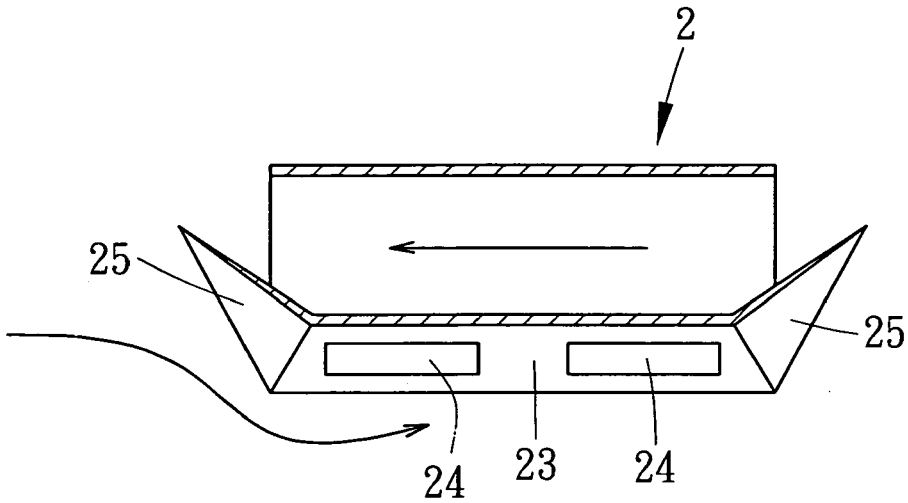
FIG. 11 is a sectional view of the shuttle according to the present invention.
Figure 12:
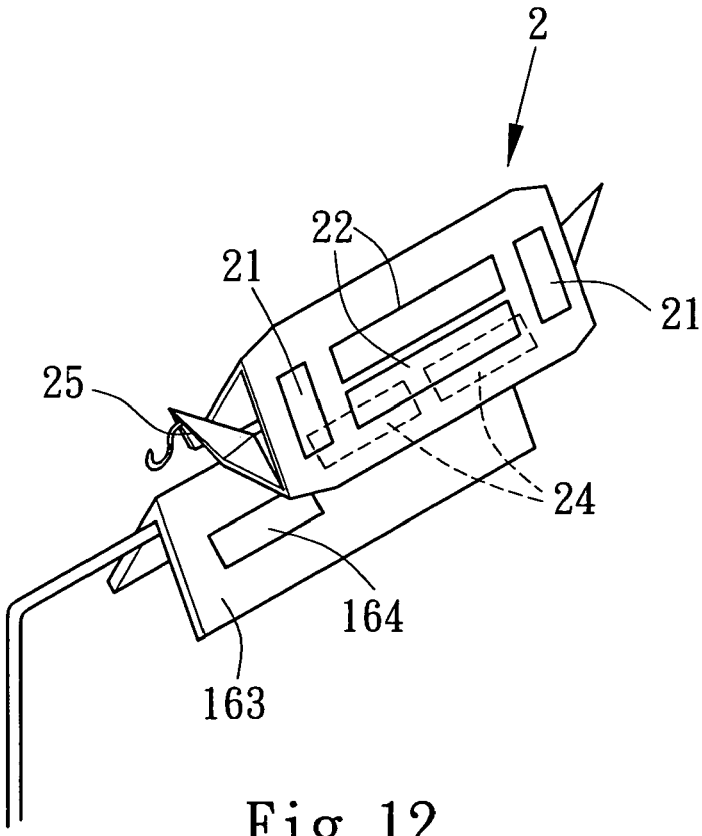
FIG. 12 is a perspective view showing the shuttled stopped at the stop plate at one end of each magnetic track according to the present invention.

Referring to FIGS. 1~6, before weaving warp threads 41 into a cloth 4, the weaving machine; referenced by 3, has a magnetic traction device 1 set at two sides of warp threads 41. The magnetic traction device 1 comprises a set of magnetic traction plates 11 defining a predetermined contained angle, a plurality of main coils 14 disposed at the bottom side of each magnetic traction plate 11 and respectively sleeved on a respective magnetic track 16 at two sides of the warp threads 41. When electrically connected, the main coils 14 produce magnetic lines of force against the magnetic lines of force of the magnetic tracks 16, thereby causing the main coils 14 to move along the magnetic tracks 16 at a high speed. By means of alternating positive and negative poles of electric current through the main coils 14, the main coils 14 are controlled to reciprocate the magnetic traction plates 11 along the magnetic tracks 16. The magnetic traction plates 11 each comprise two high-power electromagnets 12 symmetrically disposed at two sides, and an intermediate magnet 13 disposed between the high-power electromagnets 12. The magnetic lines of force of the intermediate magnets 13 extend from the outer side toward the inner side and from the upper side toward the bottom side. A shuttle 2 is set on the warp threads 41 in the contained angle within the magnetic traction plates 11, and adapted to hook weft threads. The shuttle 2 has two sloping sides corresponding to the obliquely disposed magnetic traction plates 11, and an end magnet 21 at each of the front and rear ends of each of the two sloping sides. The magnetic lines of force of the end magnets 21 of the shuttle 2 extend in direction against the extending direction of the magnetic lines of force of the high-power electromagnets 12 to constrain the shuttle 2 to stay within the magnetic traction plates 11. The shuttle 2 further comprises an intermediate magnet 22 at each of the two sloping sides between the corresponding two end magnets 21. The magnetic lines of force of the intermediate magnets 22 are against the magnetic lines of the intermediate magnets 13 of the magnetic traction plates 11. The magnetic repulsive force between the intermediate magnets 13 and 22 keeps the shuttle 2 away from the inner surface of the magnetic traction plates 11. There are provided two supplementary coils 15 respectively disposed at the front and rear sides of each main coil 14, and constantly electrically connected. When main coils 14 are off, the supplementary coils 15 are still maintained electrically connected to prevent direct contact of the main coils 14 with the magnetic tracks 16. Each two supplementary coils 15 at the front and rear sides of one main coil 14 are electrically reversed to offset the push force, so as not to affect the magnetic push force of the corresponding main coil 14.

Figure 13:
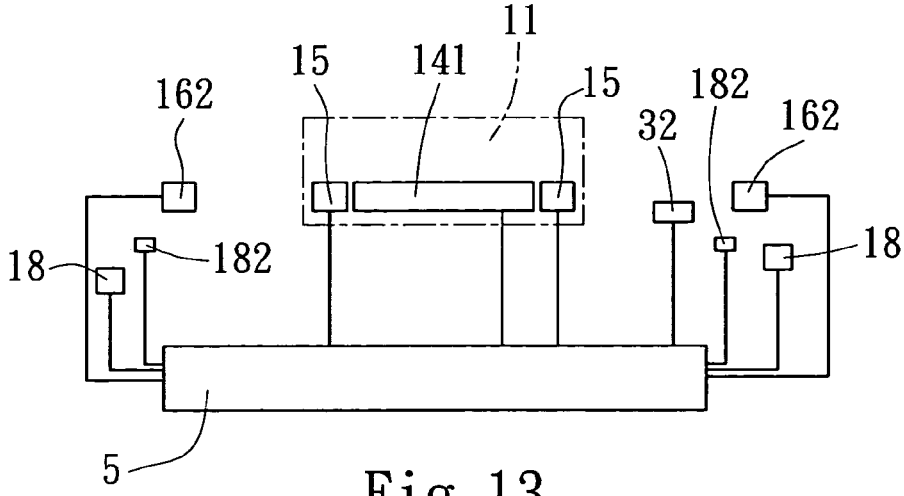
FIG. 13 is a system block diagram showing the relationship between the central control box and the related parts of the weaving machines according to the present invention.
Figure 14:
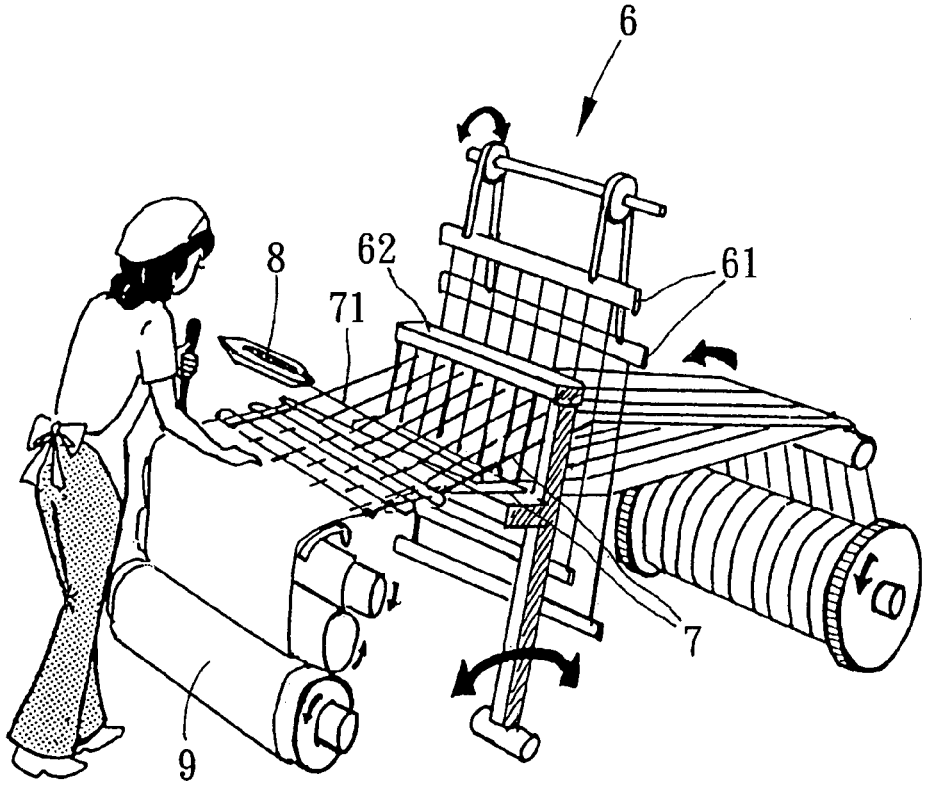
PRIOR ART Fig. 14
FIG. 14 is a schematic drawing showing the operation of a weaving machine according to the prior art.

Referring to FIGS. 7~12, two spring members 161 are provided at the two distal ends of each magnetic track 16. Each spring member 161 has the end mounted with a metal ring 166 that is not magnetically conductive, and a magnetic ring 165. When the central control box 5 sending electric current to the main coils 14, a magnetic push force is produced between the main coils 14 and the magnetic tracks 16 in one direction, thereby causing the main coils 14 to carry the magnetic traction plates 11 along the magnetic tracks 16 without contact, and therefore the shuttle 2 is moved synchronously without contact. Two photoelectric sensors 162 are provided at two sides of each magnetic track 16 near one end. When the magnetic traction plates 11 approaching one end of the magnetic tracks 16, the photoelectric sensors 162 are induced to give a signal to the central control box 5, thereby causing the central control box 5 to cut off power supply from the main coils 14, for enabling the main coils 14 to move along the magnetic tracks 16 to the end by means of inertia force. Further, each supplementary coil 15 has an outer end provided with a metal ring 152 that is not magnetically conductive, and a magnetic ring 153. When the magnetic traction plates 11 reached one end of the magnetic tracks 16, the magnetic rings 153 of the supplementary coils 15 and the magnetic rings 165 of the spring members 161 produce a magnetic repulsive force to compress the spring members 161 and to stop the magnetic traction plates 11. Each magnetic track 16 has a magnetic retainer 18 at each of the two distal ends. The magnetic retainer 18 comprises a latch 181 having a beveled front end. Each supplementary coil 15 is provided with a beveled retaining portion 151 disposed at the bottom side (alternatively the beveled retaining portion may be provided at each main coil). When the magnetic traction plates 11 reached one end of the magnetic tracks 16, the latch 181 is moved over the beveled face of the beveled retaining portion 151 and then stopped in place by the latch 181. When the central control box 5 sending electric current to the main coils 14 and the magnetic retainers 18, the magnetic latch 181 of each magnetic retainers 18 is released from the corresponding beveled retaining portion 151 to unlock the main coils 14, enabling the main coils 14 to move along the magnetic tracks 16 toward the other end without contact. When unlocked the main coils 14, the returning force of the compressed spring members 161 and the magnetic repulsive force between the magnetic rings 153 and 165 give a starting push force to the main coils 14 (see FIG. 9-1), and therefore the main coils 14 are moved toward the other end of the magnetic tracks 16 rapidly. The on/off operation of the main coils 14 and the reversing of electric current to the main coils 14 are automatically controlled by the central control box 5, therefore the magnetic traction plates 11 are drive to reciprocate the shuttle 2 through the warp threads 41 at a high speed, causing the shuttle 2 to move weft threads between each two warp threads 41 (see FIG. 13). After each stroke of the shuttle 2 to move the weft threads to one side of the weaving machine 3, the mechanism of the weaving machine 3 drive the hardness member 31 to move along the moving direction of the weft threads below the warp threads 41 to push right the weft threads. When the hardness member 31 returned to its former position, it touches a micro switch 32, thereby causing the central control box 5 to send electric current to the magnetic retainers 18 to unlock the main coils 14, for enabling the spring members 161 to push the magnetic traction plates 11 toward the other side of the weaving machine 3. At the same time, the returning latch 181 of each magnetic retainer 18 touches a sensor 182, thereby causing the central control box 5 to send electric current to the main coils 14 to produce a magnetic push force. Further, the shuttle 2 has two sloping faces 25 bilaterally disposed at the bottom side, forming a double-bevel bottom surface 23. The shuttle 2 is made of light-weight material that is not electrically conductive. When the magnetic traction plates 11 carries the shuttle 2 to move along the magnetic tracks 16 by means of magnetic force, a flow of air passes over the two sloping faces 25 of the shuttle 2 and gathered at the double-bevel bottom surface 23 to give a lifting force to the shuttle 2, and therefore the shuttle 2 is kept floating when moved with the magnetic traction plates 11. Further, each magnetic track 16 comprises a double-beveled stop plate 163 on the middle of each end, and two magnets 164 respectively disposed at the two sloping sides of the double-beveled stop plate 163. When the shuttle 2 moved with the magnetic traction plates 11 to one end of the magnetic tracks 16 and stopped, a magnetic repulsive force is produced between the magnets 164 at the double-beveled stop plate 163 and the magnets 24 at the shuttle 2, preventing contact of the shuttle 2 with the magnetic tracks 16. The main coils 14 are constantly maintained at a low temperature to reduce the impedance and to prolong the service life. In order to keep the main coils 14 at a low temperature, a hollow cylindrical cover 141 is sleeved onto each main coil 14. The hollow cylindrical covering 141 has a filling hole 142 in the peripheral wall through which liquid nitrogen is filled into the inside of the hollow cylindrical covering 141 to keep the respective main coil 14 within the normal low working temperature. Further, magnetic rails 17 are symmetrically disposed below the main coils 14 corresponding to the length of the magnetic tracks 16. Each main coil 14 is pivotally fastened with an adjustment plate 144. The adjustment plate 144 having a plurality of top lugs 146 respectively pivoted to respective lugs 143 of the main coil 14. The lugs 143 and 146 each have a rectangular hole 1431 into which the rectangular shoulder 1481 of a respective screw 148 is fitted and screwed up with an adjustment wing nut 147. By means of the adjustment wing nuts 147, the distance between the adjustment plate 144 and the corresponding magnetic rail 17 is adjusted. The adjustment plate 144 has magnets 145 adapted to produce a magnetic repulsive force to the corresponding magnetic rail 17, preventing direct contact between the respective adjustment plate 144 and the respective magnetic rail 17 and, controlling adjustment of contained angle of the magnetic traction plates 11. Further, the electric wires 19 between the central control box 5 and the coils 14 and 15 are wound round a magnetic rod 192, and a magnetic cap 191 is sleeved onto the magnetic rod 192 and capped on the electric wires 19 to produce a magnetic repulsive force relative to the magnetic rod 192. Therefore, no friction is produced during reciprocating motion of the electric wires 19 with the magnetic traction device 1.

A prototype of weaving machine has been constructed with the features of FIGS. 1~13. The weaving machine functions smoothly to provide all of the features discussed earlier.

Although a particular embodiment of the invention has been described in detail for purposes of illustration, various modifications and enhancements may be made without departing from the spirit and scope of the invention. For example, the fans used can be cooling fans for use in hot weather, or fans with electric heater means for use in cold weather. Accordingly, the invention is not to be limited except as by the appended claims.

What the invention claimed is:

1. A weaving machine comprising a magnetic traction device, said magnetic traction device comprising two magnetic tracks arranged in parallel at two sides of warp threads, a set of magnetic traction plates disposed at two sides of warp threads and defining a contained angle, a plurality of main coils respectively disposed at a bottom side of each of said magnetic traction plates and respectively sleeved onto said magnetic tracks and adapted to reciprocate along said magnetic tracks without contact when alternatively reversely connected with electric current, said magnetic traction plates each having two end magnets and an intermediate magnet respectively disposed at each of two opposing inner sides, said end magnets having magnetic lines of force extending from an outer side toward an inner side, said intermediate magnetic having magnetic lines of force extending from an outer side toward an inner side and from an upper side toward a bottom side, said magnetic tracks each having a buffer spring member at each of two distal ends thereof;

a shuttle set in warp threads within the contained angle of said magnetic traction plates and adapted to move weft threads over warp threads, said shuttles comprising two sloping sidewalls, two end magnets respectively disposed at front and rear sides of each of said two sloping sidewalls and adapted to act with the end magnets at said magnetic traction plates to keep said shuttles be suspended within the contained angle of said magnetic traction plates, an intermediate magnet disposed between the two end magnets at each of the two sloping sidewalls and adapted to produce a magnetic repulsive force against the intermediate magnets at said magnetic traction plates to keep said shuttle away from an inner surface of said magnetic traction plates;

a set of magnetic rails symmetrically provided at said main coils at a bottom side corresponding to the length of said magnetic tracks; and a set of adjustment plates respectively pivoted to said main coils at a bottom side and adapted to adjust the contained angle of said magnetic traction plates, said adjustment plates each comprising a plurality of lugs respectively pivoted to respective lugs at said main coils, and adjustment screws respectively fastened to said lugs and adapted to adjust the pitch between said adjustment plates and said magnetic rails, said adjustment plates each having a plurality of magnets mounted thereon and adapted to produce a magnetic repulsive force against said magnetic rail to keep said adjustment plates out of contact with said magnetic rails;

wherein when electric current is connected to said main coils, a magnetic push force is produced between said main coils and said magnetic tracks to push said main coils and said magnetic traction plates along said magnetic tracks without contacting said magnetic tracks and simultaneously to carry said shuttle, causing said shuttle to move weft threads over warp threads.

2. The weaving machine as claimed in claim 1, further comprising two supplementary coils respectively disposed at front and rear sides of each said main coil and constantly electrically connected to support said main coils on said magnetic tracks without contacting said magnetic tracks, said two supplementary coils being connected with reversed current to offset push force with each other.

3. The weaving machine as claimed in claim 1, further comprising a plurality of photoelectric sensors respectively disposed near two distal ends of said magnetic tracks and adapted to cut off power supply from said main coils when said magnetic traction plates approaching one end of said magnetic tracks.

4. The weaving machine as claimed in claim 2, wherein 1, wherein said buffer spring members each have a rear end mounted with a magnetic ring and a magnetically nonconductive metal ring; said supplementary coils each are provided with a magnetic ring and a magnetically nonconductive metal ring corresponding to the magnetic ring and magnetically nonconductive metal ring at each said buffer spring member, the magnetic rings of said supplementary coils being adapted to produce a magnetic repulsive force against the magnetic rings at said buffer spring members when said magnetic traction plates approaching one end of said magnetic tracks.

5. The weaving machine as claimed in claim 3, wherein said main coils and said supplementary coils having a plurality of beveled retaining portions; said magnetic tracks each comprise a magnetic retainer at each of two distal ends thereof, said magnetic retainer comprising a latch having a beveled front end and adapted to engage the beveled retaining portions of said main coils and said supplementary coils when said magnetic traction plates moved to one end of said magnetic tracks.

6. The weaving machine as claimed in claim 1, wherein said main coils each are covered with a hollow cylindrical covering, said hollow cylindrical covering having a filling hole through which liquid nitrogen is filled into said hollow cylindrical covering to keep said main coils in a low temperature working condition.

7. The weaving machine as claimed in claim 1, wherein said shuttle is made of a magnetically nonconductive light-weight material, having a double-beveled bottom wall such that a flow of current is moved along two opposite sloping sidewalls of said shuttle and gathered at said double-beveled bottom wall to lift said shuttle during reciprocating motion of said shuttle with said magnetic traction plates along said magnetic tracks.

8. The weaving machine as claimed in claim 1, wherein said magnetic tracks each comprise a double-beveled stop plate at each of two distal ends thereof on the middle, said double-beveled stop plate having a plurality of magnets disposed at two sloping sidewalls thereof adapted to produce a magnetic repulsive force against the magnets at said shuttle to keep said shuttle away from said magnetic tracks when said shuttle is stopped from movement.

9. The weaving machine as claimed in claim 1, further comprising a central control box adapted to control power on/off at said main coils and reversing of electric current to said main coils.

* * * * *